United States Patent [19]

Trokhan

[11] 4,239,065

[45] Dec. 16, 1980

[54] PAPERMACHINE CLOTHING HAVING A SURFACE COMPRISING A BILATERALLY STAGGERED ARRAY OF WICKER-BASKET-LIKE CAVITIES

[75] Inventor: Paul D. Trokhan, Hamilton, Ohio

[73] Assignee: The Procter & Gamble Company, Cincinnati, Ohio

[21] Appl. No.: 19,028

[22] Filed: Mar. 9, 1979

[51] Int. Cl.[3] ..... D03D 15/00

[52] U.S. Cl. ..... 139/383 A; 139/425 A; 162/DIG. 1; 428/223

[58] Field of Search ..... 139/383 R, 383 A, 425 A, 139/420 R; 162/DIG. 1, 109, 348; 428/224, 225

[56] References Cited

U.S. PATENT DOCUMENTS

| | | | |
|---|---|---|---|
| 3,851,681 | 12/1974 | Egan | 162/348 X |
| 3,905,863 | 9/1975 | Ayers | 139/425 A |
| 4,142,557 | 3/1979 | Kositzke | 139/425 A |
| 4,157,276 | 6/1979 | Wandel et al. | 139/425 A |
| 4,161,195 | 7/1979 | Khan | 161/348 X |

*Primary Examiner*—Henry Jaudon

*Attorney, Agent, or Firm*—Thomas J. Slone; Fredrick H. Braun; Richard C. Witte

[57] ABSTRACT

Papermachine clothing, for instance, a loop of imprinting fabric, is disclosed which is so woven that a top-surface-plane thereof is defined by coplanar crossovers of filaments of at least two sets of filaments (i.e., warp and shute filaments) and so that sub-top-surface crossovers are distributed in a predetermined pattern throughout the clothing. Specific weaves are disclosed wherein the top-surface crossovers act corporately to define a top surface comprising a bilaterally staggered array of wicker-basket-like cavities which cavities each span at least one sub-top-surface crossover. Such clothing is particularly useful for making soft, absorbent paper of relatively low density, and relatively isotropic stretch properties when creped.

17 Claims, 15 Drawing Figures

PAPERMACHINE CLOTHING HAVING A SURFACE COMPRISING A BILATERALLY STAGGERED ARRAY OF WICKER-BASKET-LIKE CAVITIES

DESCRIPTION

Technical Field

This invention relates to papermachine clothing including forming wires, backing wires, and drying and imprinting fabrics for use on single wire papermachines as well as the newer breeds of multiple wire and/or multiple layering papermachines. Particular emphasis is directed to imprinting fabrics for producing paper characterized by an array of bilaterally staggered uncompressed zones which are discretely perimetrically enclosed by compacted picket-like-lineaments. Such paper, particularly after being creped is characterized by relatively high bulk; an improved CD:MD stretch ratio; reduced flexural rigidity; and improved burst to total tensile strength ratio.

Background Art

A soft, absorbent, wet-laid imprinted creped paper which is characterized by alternately spaced unbroken ridges of uncompressed fibers and troughs of compressed fibers, which ridges and troughs extend in the cross-machine-direction (hereinafter CD) is disclosed in U.S. Pat. No. 3,301,746 which issued Jan. 31, 1967 to L. H. Sanford et al., as well as a process for making such paper. The Sanford et al. patent expressly discloses the use of imprinting fabrics which may be of square or diagonal weave, as well as twilled and semi-twilled fabrics.

Another soft, absorbent wet-laid imprinted creped paper which is characterized by discrete CD aligned uncompressed zones or pillows is disclosed in U.S. Pat. No. 3,974,025 which issued Aug. 10, 1976 to Peter G. Ayers, and a process for making such paper is disclosed in U.S. Pat. No. 3,905,863 which issued Sept. 16, 1975 to Peter G. Ayers. These patents disclose imprinting the paper with an imprinting pattern from the back side of a semi-twill woven imprinting fabric which has been heat-set and abraded to provide monoplanar (coplanar) flat-faced knuckles.

As compared to the paper characterized by unbroken uncompressed CD ridges of Sanford et al., and the paper characterized by CD aligned uncompressed zones of Ayers, the paper provided through the use of imprinting fabrics embodying the present invention is characterized by an array of uncompressed zones of fibers which are disposed in staggered relation in both the CD and the machine direction (hereinafter MD), and which zones are perimetrically enclosed by picket-like lineaments comprising alternately spaced regions of compressed and uncompressed fibers; that is, by discontinuous rather than unbroken or continuous lines of compression.

An absorbent pad of air-laid fibers which is pattern densified essentially only by means of compression to provide a bilaterally staggered array of generally circular uncompressed tufts is disclosed in U.S. Pat. No. 3,908,659 which issued Sept. 30, 1975 to Bernard Martin Wehrmeyer et al. As compared to this dry-laid structure having continuous lines of compression, the paper provided through the use of imprinting fabrics embodying the present invention is wet-laid, and has discontinuous lines/lineaments of compression/imprinting which are imparted to the paper prior to its final drying. The paper may also be creped after being imprinted and dried.

A fragmentary view of a 5-shed satin weave fabric having a non-numerically-consecutive warp-pick-sequence (1, 4, 2, 5, 3) is shown in FIGS. 3–7, page 22, of the book titled *Papermachine Felts and Fabrics,* copyrighted by Albany International Corporation, 1976; Library of Congress Cat. Card No. 76–41647. Also, wet-end fabrics (commonly referred to as "wires" albeit comprising thermoplastic filaments rather than metal wire) of this weave are commercially available from Appleton Wire Works Corp., Appleton, Wisc. However, the book reference does not disclose or suggest such a woven fabric which is finished as by stressing and heat setting to provide an array of coplanar top-surface-plane crossovers of both warp and shute filaments and an interspersed array of sub-top-surface crossovers distributed throughout the fabric. Moreover, the use of such a fabric as an imprinting fabric is not disclosed and, therefore, this reference does not teach the use of such a fabric to achieve a particular objective with respect to the structure of a paper sheet imprinted thereby.

U.S. Pat. No. 3,473,566 which issued Oct. 21, 1969 to J. S. Amneus teaches the weaving and heat treating of polyester fabrics to provide warp and shute knuckles having equal heights; that is coplanar top surfaces.

U.S. Pat. No. 3,573,164 which issued Mar. 30, 1971 to N. D. Friedberg and Charles L. Wosaba II discloses abrading high portions of filament crossovers to provide flat-faced coplanar knuckles as shown in FIGS. 3 and 4 thereof. Such flat-faced coplanar knuckles are incorporated in the heat-set imprinting fabrics disclosed in the Ayers' patents discussed hereinabove.

As compared to the background art, the present invention provides fabrics which, when used as imprinting fabrics, are suitable for use in a papermaking machine to make a soft, absorbent wet-laid sheet of paper which is characterized by an array of uncompressed and/or uncompacted zones which zones are disposed in staggered relation in both the machine direction and the cross-machine direction and which zones are perimetrically enclosed by imprinting imparted (i.e., compacted) picket-like discontinuous lineaments. When creped, this paper provides relatively high bulk; an improved CD:MD stretch ratio; reduced CD flexural rigidity which is believed to impute an increased subjectively ascertainable softness impression; and improved burst to total tensile strength ratio. Moreover, each fabric embodiment of the present invention is characterized by having coplanar top surfaces of both warp and shute filament crossovers and by having sub-top-surface crossovers disposed throughout the fabric in a predetermined pattern so that a sub-array of one or more sub-top-surface crossovers is perimetrically enclosed by portions of the coplanar warp and shute crossovers. Each such network or grouping of coplanar crossovers and sub-top-surface crossovers and the intermediate spans of filaments form, in the nature of wicker-like baskets, concave depressions or wicker-basket-like cavities in the top surface of the fabric in each of which cavities a zone of an embryonic paper web can be accommodated without substantial compression or compaction while the pattern of coplanar crossovers is imprinted on the embryonic paper web. The cavities are arrayed in staggered relation in both the machine direction and the cross-machine direction.

DISCLOSURE OF THE INVENTION

In accordance with an aspect of the present invention, there is provided a loop of fabric for use on a papermaking machine which comprises at least two sets of filaments which, in each set, are generally parallel to each other and which sets are relatively steeply angularly related to each other. This is conventionally orthogonal but it is not intended to thereby limit the present invention. The filaments are so woven and complimentarily serpentinely configured in at least the Z-direction (the thickness of the fabric) to provide a first grouping or array of coplanar top-surface-plane crossovers of both sets of filaments; and a predetermined second grouping or array of sub-top-surface crossovers. The arrays are interspersed so that portions of the top-surface-plane crossovers define an array of wicker-basket-like cavities in the top surface of the fabric which cavities are disposed in staggered relation in both the machine direction (MD) and the cross-machine direction (CD), and so that each cavity spans at least one sub-top-surface crossover. The cavities are discretely perimetrically enclosed in the plan view by a picket-like-lineament comprising portions of a plurality of the top-surface plane crossovers. The loop of fabric may comprise heat set monofilaments of thermoplastic material; the top surfaces of the coplanar top-surface-plane crossovers may be monoplanar flat surfaces. Specific embodiments of the invention include satin weaves as well as hybrid weaves of five or greater sheds, and mesh counts of from about 10×10 to about 120×120 filaments per inch (4×4 to about 47×47 per centimeter). Although the preferred range of mesh counts is from about 18 by 16 to about 45 by 38 filaments per inch (9×8 to about 18×15 per centimeter).

BRIEF DESCRIPTION OF THE DRAWINGS

While the claims hereof particularly point out and distinctly claim the subject matter of the present invention, it is believed the invention will be better understood in view of the following detailed description of the invention taken in conjunction with the accompanying drawings in which corresponding features of the several views are identically designated, and in which:

DETAILED DESCRIPTION OF THE INVENTION

Prior to describing several alternate fabric embodiments of the present invention, fabric weaving and nomenclature need to be reviewed.

The terms warp and shute (or woof) are terms associated with fabric on a loom: warp threads or filaments extend longitudinally in a loom; and shute threads or filaments extend in the lateral direction in a loom. Fabrics woven on conventional looms are formed into loops by weaving the top and bottom laterally extending edges of the fabric together with warp ends which have been left extending from the top and bottom edges of the fabric. Thus, when such a fabric is placed on a papermaking machine the warp filaments extend in the machine-direction, and the shute filaments extend in the cross-machine direction. Alternatively, endless loops of fabric can be woven on suitable looms wherein the warps and shutes are so disposed that, when the loop is applied to a papermaking machine, the warps extend in the cross-machine-direction and the shutes extend in the machine-direction. Thus, the terms warp and shute are potentially ambiguous with respect to machine-direction and cross-machine-direction. Accordingly, the weaves described hereinbelow are, for convenience and simplicity, explained using warp and shute with the intention that either can extend in either the MD or CD on a papermaking machine. For that reason, neither MD nor CD is indicated on the figures. Accordingly, in more general terms, the fabrics comprise two sets of substantially parallel filaments which sets are generally disposed substantially orthogonal with respect to each other.

Figure 1:
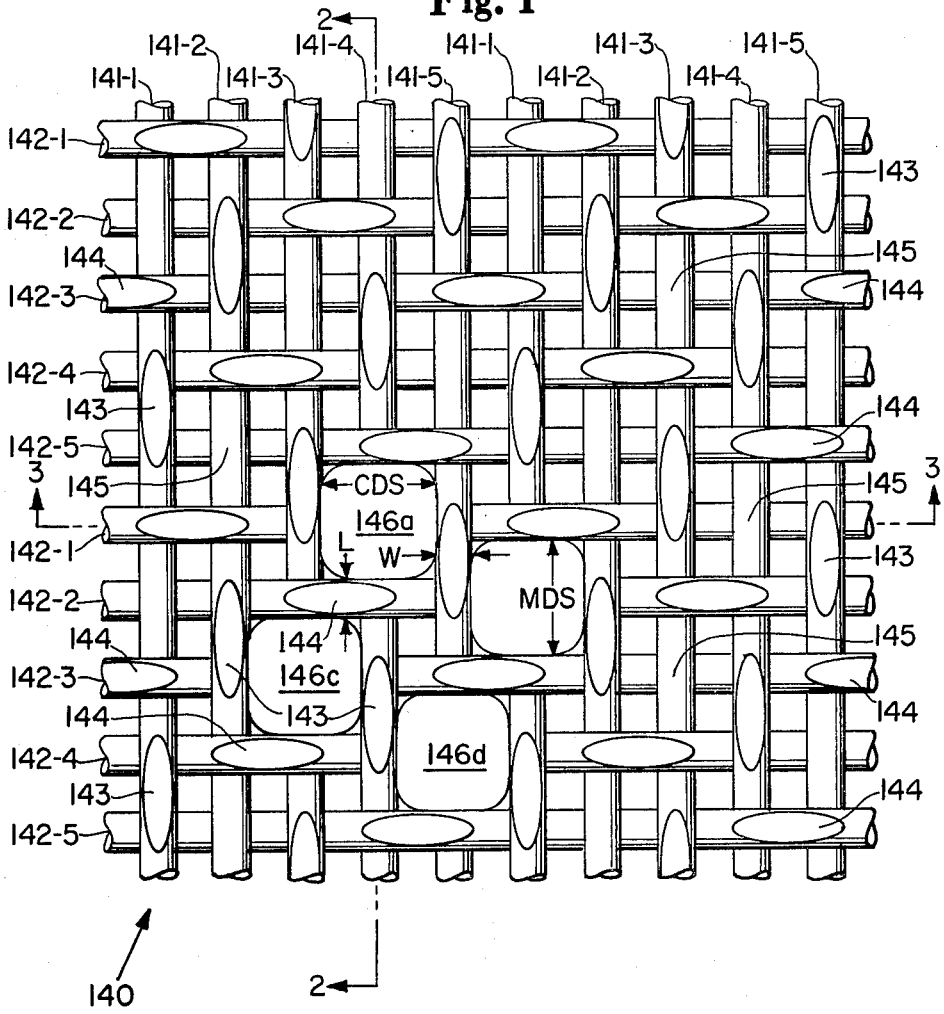
FIG. 1 is an enlarged scale, fragmentary plan view of a hybrid 5-shed fabric for use on a papermachine which fabric is a preferred embodiment of the present invention.

Referring now to the figures in which like features are identically designated, FIG. 1 is a plan view of a fragmentary piece of an imprinting fabric 140 of, for instance, monofilament polyester, which is a preferred embodiment of the present invention. Fabric 140 is a five-shed hybrid weave which comprises sets of warps 141-1 through 141-5 and sets of shutes 142-1 through 142-5, and which fabric has been woven by passing each shute over two and under three warps, and in which each successive warp is passed over the next two successive warps adjacent the pair of warps over which the preceding shute passed. Thus, the shute knuckles of adjacent shutes are offset from each other by the number of filaments spanned by each shute knuckle. The fabric has been stressed and heat treated to provide coplanar crossovers which have been abraded to become coplanar flat knuckles 143 and 144, and the stressing and heat treating have precipitated, sub-top-surface knuckles 145. Planchets **146*a* through 146*d* cover four adjacent wicker-basket-like cavities in the fabric which each spans one sub-top-surface knuckle 145 and is perimetrically enclosed by a picket-like-lineament comprising portions of adjacent coplanar knuckles 143 and 144**.

Such cavities are said to be isotropic because they span equal numbers of warp and shute filaments; one each in fabric 140.

Figure 2:
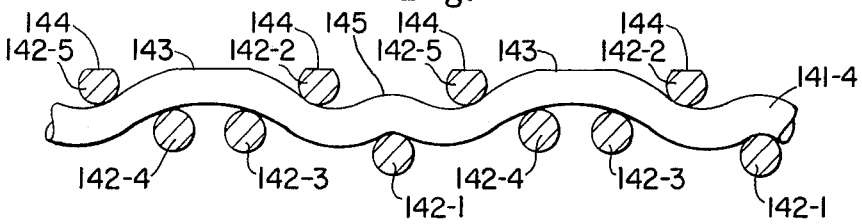
FIGS. 2 and 3 are fragmentary sectional views taken along lines 2—2 and 3—3, respectively, of FIG. 1.
Figure 3:
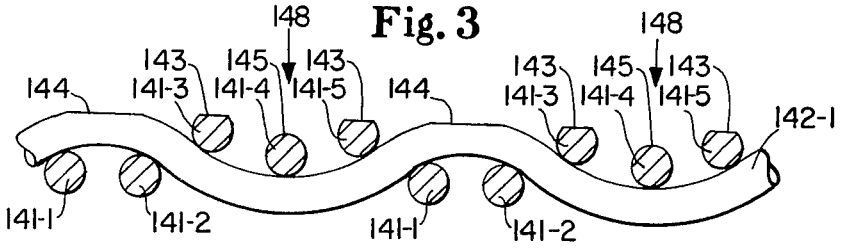

FIGS. 2 and 3 are sectional views taken along lines 2—2 and 3—3, respectively, of FIG. 1. These figures clearly show the heat set, complimentarily serpentinely configured warp and shute filaments and the relative elevational dispositions of the knuckles 143, 144 and 145: coplanar knuckles 143 and 144, and knuckle 145 being spaced subjacent the top surface plane defined by coplanar knuckles 143 and 144. The elevational profile of one of the wicker-basket-like cavities is best seen in FIG. 3 and identified by designator 148.

Still referring to FIG. 1, the grouping of the four cavity-shape planchets 146*a* through 146*d* clearly shows that the array of wicker-basket-like cavities of fabric 140 are sufficiently closely spaced that the machine direction span MDS of each cavity (a reference cavity) spans the machine direction length L of the space intermediate a longitudinally spaced pair of cavities which pair is disposed laterally adjacent the reference cavity, and the cavities of the array are sufficiently closely spaced that the cross-machine-direction span CDS of each cavity spans the cross-machine-direction width W of the space intermediate a laterally spaced pair of cavities which pair is disposed longitudinally adjacent the reference cavity. To illustrate these spatial relations planchets 146*a* and 146*c*, FIG. 1, are a pair of longitudinally spaced planchets which pair is disposed laterally adjacent planchet 146*b*, and planchets 146*a* and 146*b* are a pair of laterally spaced planchets which pair is disposed longitudinally adjacent planchet 146*d*. This degree of overlapping relations tends to obviate MD and CD tearing of paper imprinted by such fabrics, and such fabrics are hereby designated fully overlapped bilaterally staggered cavity-type imprinting fabrics.

Still referring to Fabric 140, FIGS. 1 through 3, it is apparent that the cavities represented by planchets 146 are not wholly fenced off from each other by adjacent portions of coplanar crossovers 143 and 144. Indeed, because of the Z-direction undulation of the filaments and the spaced relations of the crossovers 143 and 144, paper imprinted by such a fabric will be characterized by substantially discrete uncompressed zones which may be to some degree linked together by small isthmuses of paper fibers which isthmuses have been only partially compacted by the imprinting action. Nonetheless, it is believed that each cavity represented by a planchet 146 is substantially discretely perimetrically enclosed by a picket-like-lineament of portions of adjacent coplanar crossovers, and that each cavity is wicker-basket-like in configuration; its bottom being defined in part by a sub-array of one of more sub-top-surface crossovers 145.

Figure 4:
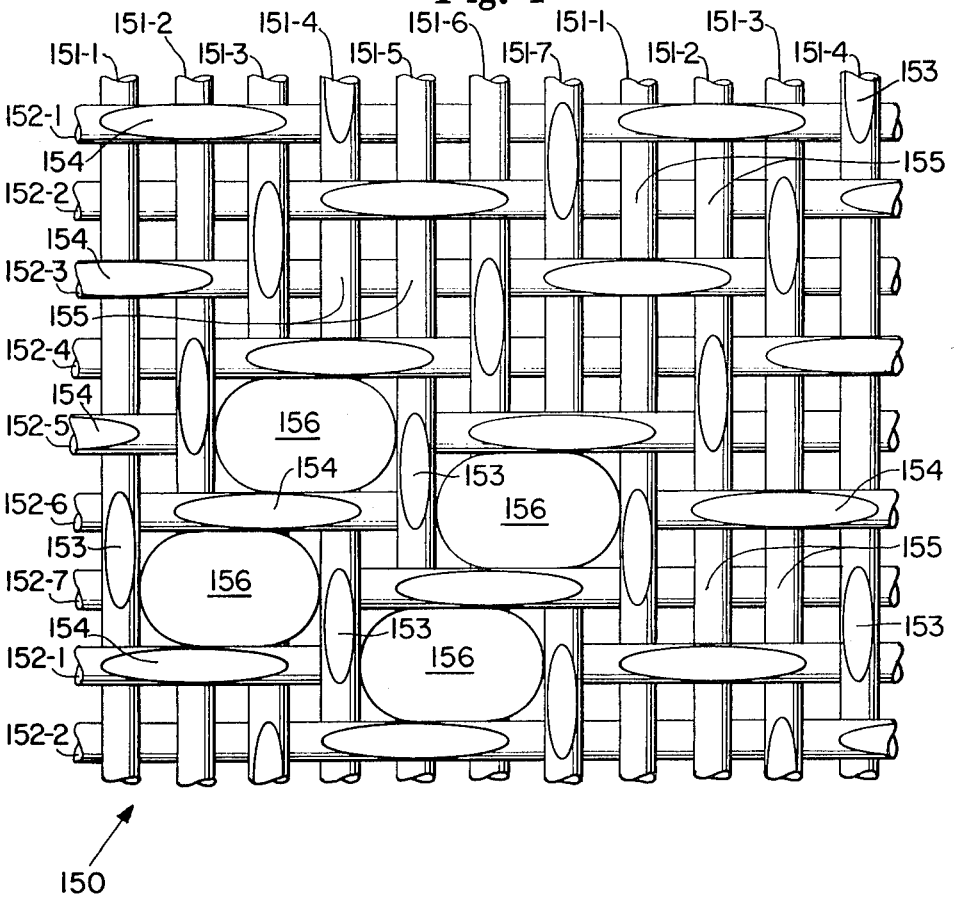
FIG. 4 is an enlarged scale fragmentary plan view of a hybrid 7-shed fabric which is an alternate embodiment of the present invention.

FIG. 4 is a plan view of a fragmentary piece of an alternate imprinting fabric 150 which is an embodiment of the present invention. Fabric 150 is a seven-shed hybrid weave which comprises sets of warps 151-1 through 151-7 and shutes 152-1 through 152-7, and which fabric has been woven with each shute alternately passing over three and under four warps. Also, each successive shute passes over the next subset of three warps adjacent to the subset of three warps over which the preceding shute passed. Thus, the knuckles of adjacent shutes are offset by the number of shute filaments each knuckle spans. In a similar manner, each warp knuckle is offset from the knuckle on adjacent warps by the number of shute filaments spanned by each warp filament knuckle. The warps and shutes have coplanar top-surface-plane knuckles 153 and 154, respectively, and side-by-side pairs of sub-top-surface knuckles 155. Planchets 156 indicate the shape of the wicker-basket-like cavities formed by the complex of coplanar top-surface-plane knuckles and sub-top-surface knuckles, which cavities each spans two adjacent sub-top-surface knuckles 155.

Figure 5:
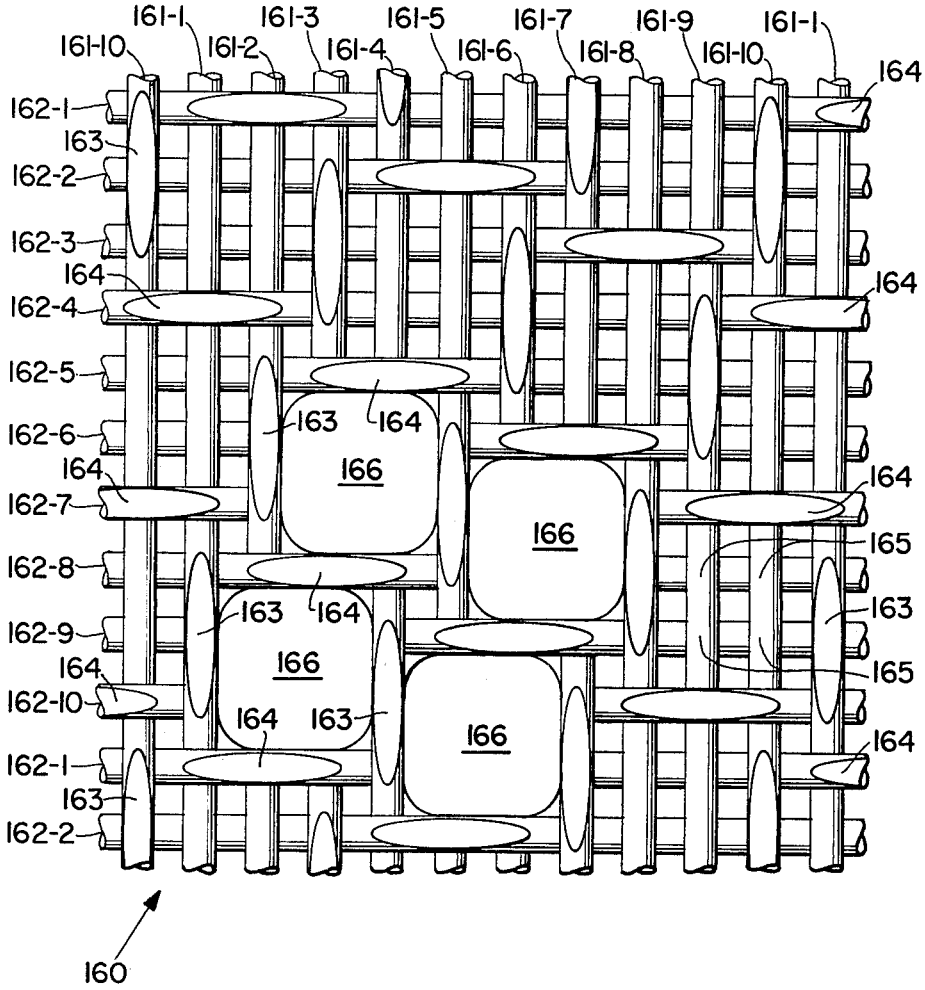
FIG. 5 is an enlarged scale, fragmentary plan view of a hybrid 10-shed fabric which is another alternate embodiment of the present invention.
Figure 6:
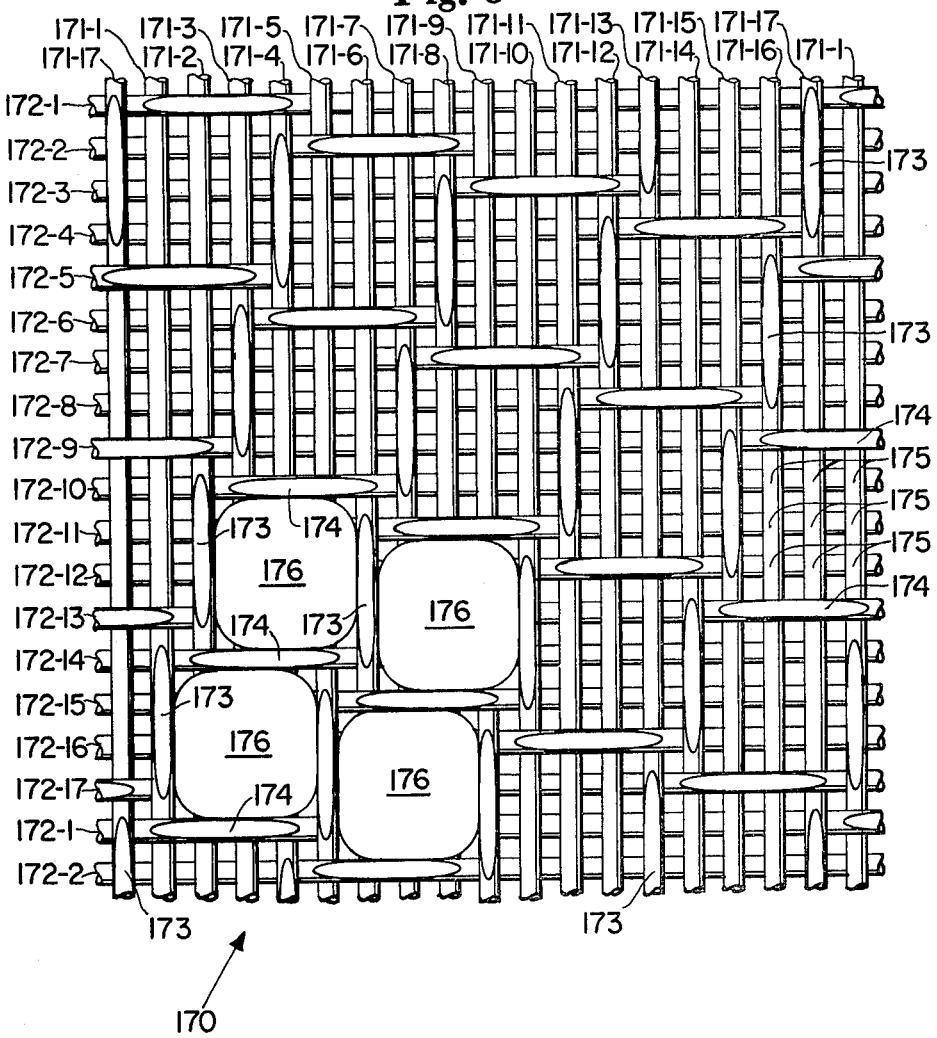
FIG. 6 is an enlarged scale, fragmentary plan view of a hybrid 17-shed fabric which is yet another alternate embodiment of the present invention.

FIGS. 5 and 6 are plan views of fragmentary pieces of other alternate embodiment imprinting fabrics 160 and 170 which provide isotropic cavities which span sub-arrays of two-by-two and three-by-three sub-top-surface knuckles 165 and 175, respectively. These cavities are indicated by planchets 166 of FIG. 5, and 176 of FIG. 6. More specifically, fabric 160, FIG. 21, is a ten-shed hybrid weave which comprises sets of warps 161-1 through 161-10 and sets of shutes 162-1 through 162-10, and are woven to provide equal length, warp and shute knuckles 163 and 164, respectively. Fabric 160 is so woven that the shute knuckles 164 of adjacent shutes 162 are offset by the number of filaments spanned by each knuckle, and each pair of adjacent warp knuckles are offset by the number of shutes spanned by each warp knuckle. In the same general manner, fabric 170 comprises sets of warp filaments 171-1 through 171-17 and sets of shute filaments 172-1 through 172-17. The fabric is woven in a four over, thirteen under mode to provide coplanar warp knuckles 173 and shute knuckles 174 of equal lengths; each spanning four filaments of the other set.

Figure 7:
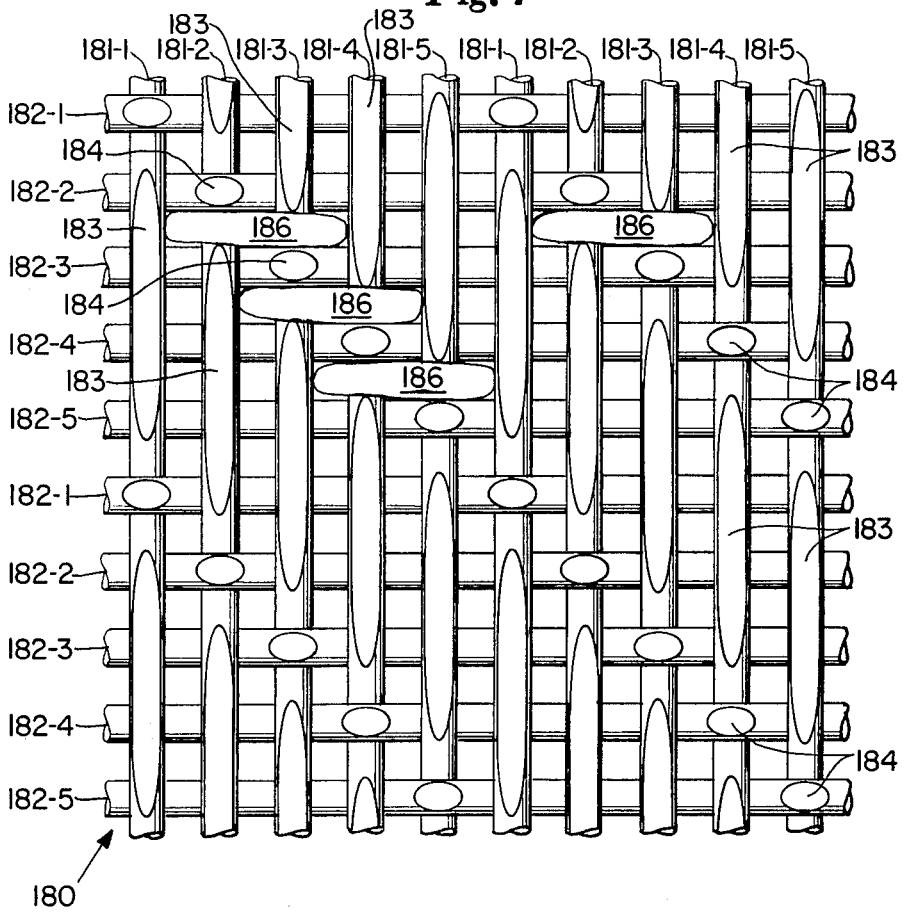
FIG. 7 is an enlarged scale, fragmentary plan view of a 5-shed satin weave fabric which has been woven by numerically consecutively picking the warp filaments on the loom.

Prior to describing several alternate embodiment satin weave fabrics, it is desirable to preview the fact that the bilaterally staggered relation of their respective arrays of wicker-basket-like cavities results from non-numerically-consecutive warp-pick-sequences. The fabric 180, FIG. 7, is included to illustrate that a numerically-consecutive warp-pick-sequence (e.g., 1, 2, 3, 4, 5) precipitates cavities indicated by planchets 186 which are disposed in rows which are aligned in the direction of the shute filaments; not bilaterally staggered. Moreover, as used herein the term "satin weave" is defined as a weave of n-shed wherein each filament of one set of filaments (e.g., warps or shutes) alternately crosses over one and under n-1 filaments of the other set of filaments (e.g., shutes or warps), and each filament of the other set of filaments alternately passes under one and over n-1 filaments of the first set of filaments. As illustrated in FIG. 7, fabric 180 is a five-shed satin weave which has been woven using a 1, 2, 3, 4, 5 warp-pick-sequence. Fabric 180 comprises warp filaments 181-1 through 181-5, and shute filaments 182-1 through 182-5. The warps have elongate flat-faced knuckles 183 and the shutes have oval-shape flat-faced knuckles 184 which knuckles 183 and 184 are coplanar. The wicker-basket-like cavities of fabric 180 are covered by planchets 186. These cavities span two warp filaments and no shute filaments; and this fabric has no sub-top-surface knuckles comparable to, for instance, knuckles 195 of fabric 190, FIG. 8 as described more fully below. By way of contrast, the cavities of fabric 190, FIG. 8, span two warp filaments and one shute filament as indicated by planchets 196 which span two side-by-side sub-top-surface knuckles 195. Thus, the five-shed satin weave fabric 180 (numerically-consecutive warp-pick-sequence), FIG. 7, has no sub-top-surface crossovers whereas the five-shed satin weave fabric 190 (non-numerically-consecutive warp-pick-sequence), FIG. 8 has sub-top-surface crossovers 195.

The phrase warp-pick-sequence as used above and hereinbelow relates to the sequence of manipulating the longitudinally extending warp filaments in a loom to weave a fabric as the shuttle is traversed back and forth laying the shute filaments. If, as in all of the plan-view figures of fabric pieces included in this application, the warps are cyclically numbered from left to right so that they are numbered in sets of 1 through n for an n shed fabric (e.g.: warps 181-1 through 181-5 for the 5-shed, n=5 fabric shown in FIG. 7), then warp-pick-sequence refers to the order of displacing the warps downwardly (into the paper as shown in FIG. 7) so that the next shute filament passes over the picked warp and under the other warps. Referring still to FIG. 7, shute 182-1 was laid while all warps designated 181-1 were picked, and while all warps designated 181-2 through 181-5 were not picked. Thus, shute 182-1 passes over all warps 181-1 and under all warps 181-2 through 181-5 as shown in FIG. 7. Then, warps 181-1 are released and warps 181-2 are picked prior to passing the shuttle to lay shute 182-2. In the same manner, warps 181-3 are picked prior to laying shute 182-3; warps 181-4 are picked prior to laying shute 182-4; and warps 181-5 are picked prior to laying shute 182-5. Thus, using only the suffix digits of the warp and shute designators, the warp-pick-sequence to weave fabric 180, FIG. 7, is 1, 2, 3, 4, 5 to lay shutes 1 through 5, respectively. This is a numerically-consecutive warp-pick-sequence as distinguished from the non-numerically-consecutive warp-pick-sequence manifest in fabrics 190, FIG. 8, which fabric has a warp-pick-sequence of 1, 3, 5, 2, 4. Fabrics woven with non-numerically-consecutive warp-pick-sequences are amenable to being stressed and heat treated to provide coplanar warp and shute crossovers and some recessed sub-top-surface crossovers as described more fully hereinafter whereas fabrics woven with numerically consecutive warp-pick-sequences have no such sub-top-surface (recessed) crossovers. Also, opposite hand weaves having substantially similar properties can be formed through the use of a complimentary warp-pick-sequence. For instance, the compliment of 1, 3, 5, 2, 4 is 1, 4, 2, 5, 3; and the compliment of 1, 2, 3, 4, 5 is 5, 4, 3, 2, 1. Alternatively, the compliment (opposite hand weave) can in fact be achieved by numbering the warps from right to left rather than left to right. That is, a fabric having its warps cyclically numbered -1 through -5 from left to right and woven with a warp-pick-sequence of 1, 3, 5, 2, 4 is the complimentary opposite hand weave of a fabric having its warps cyclically numbered -1 through -5 from right to left and woven with the same warp-pick-sequence of 1, 3, 5, 2, 4.

Figure 8:
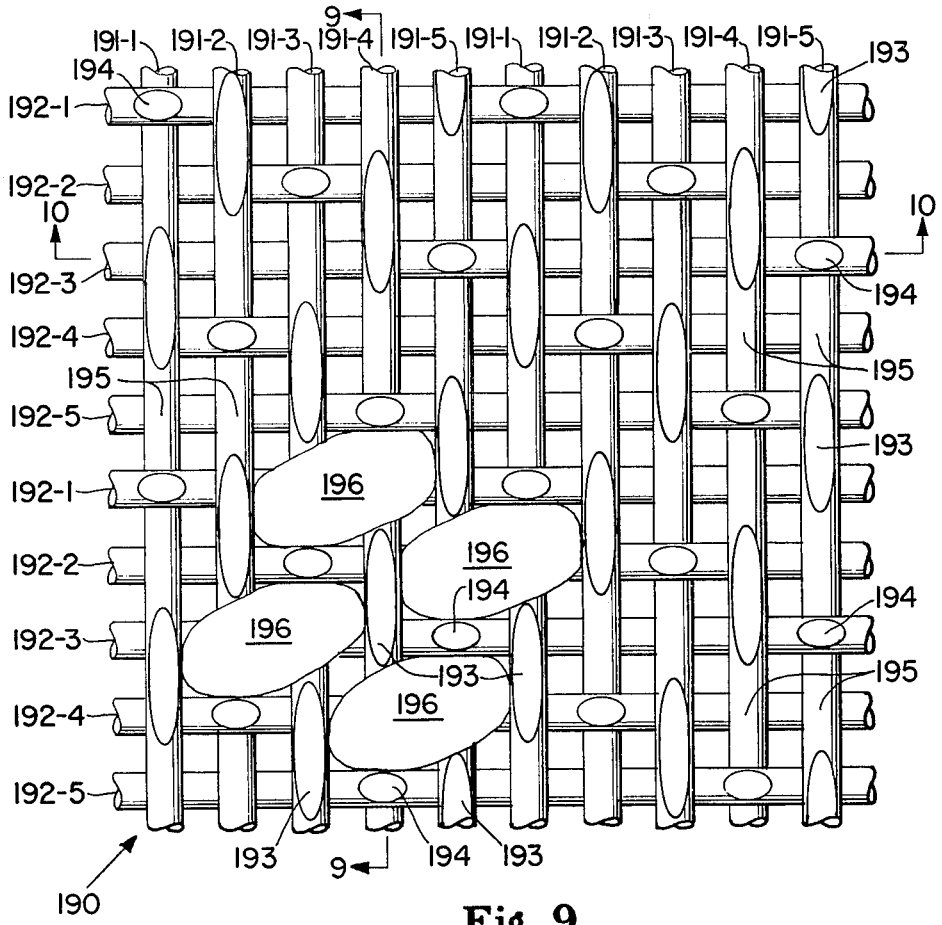
FIG. 8 is an enlarged scale, fragmentary plan view of a 5-shed satin weave imprinting fabric which has been woven by picking the warps in a non-numerically-consecutive sequence, to wit: 1, 3, 5, 2, 4.
Figure 9:
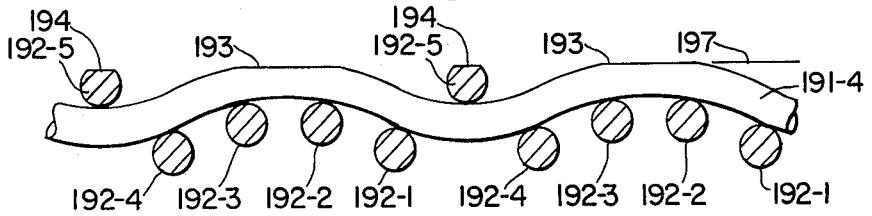
FIGS. 9 and 10 are fragmentary sectional views taken along lines 9—9 and 10—10, respectively, of FIG. 8.
Figure 10:
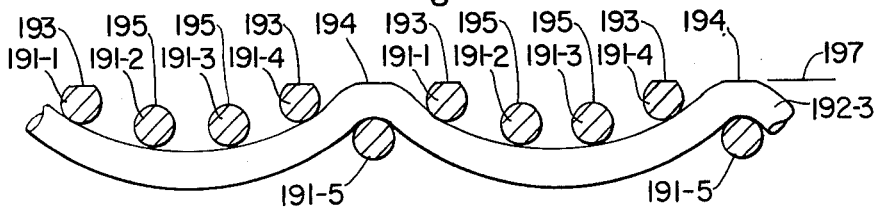

FIG. 8 is a fragmentary plan view of an imprinting fabric 190 having four (4) oval-shape planchets 196 disposed thereon. Fabric 190 comprises monofilament thermoplastic warps and shutes; preferably a polyester. The warps and shutes of fabric 190 are designated warp filaments 191-1 through 191-5, and shute filaments 192-1 through 192-5 which are woven into a 5-shed satin weave using a non-numerically-consecutive 1, 3, 5, 2, 4 warp-pick-sequence. After being woven, fabric 190 is heat treated under tension to heat set the filaments in the complimentary serpentine configurations shown in the fragmentary sectional views taken along lines 9—9 and 10—10 of FIG. 8 and which views are identified as FIGS. 9 and 10, respectively. After being heat set, the fabric 190 is subjected to an abrading means to provide elongate flat-faced crossovers (knuckles) 193 on the warp filaments 191-1 through 191-5, and oval-shape flat-faced crossovers (knuckles) 194 on the shute filaments 192-1 through 192-5. The flat-faced crossovers 193 and 194 are coplanar and are alternately corporately designed top-surface-plane crossovers. That is, the flat faces of crossovers 193 and 194 define the top surface plane 197, FIGS. 9 and 10, of fabric 190. The remainder of fabric 190 is disposed below plane 197 and includes sub-top-surface crossovers (knuckles) 195. Thus, as shown in FIGS. 8 and 10, sub-top-surface crossovers 195 are disposed in sub-arrays of side-by-side pairs and, as shown in FIG. 8, each pair of sub-top-surface crossovers 195 is generally perimetrically enclosed by adjacent portions of four warp crossovers 193 and two shute crossovers 194. Each such network of crossover portions and the intermediate spans of filaments form, in the nature of wicker-like baskets, concave depressions or cavities in which zones of an embryonic paper web can be accommodated without substantial compression or compaction while the coplanar top-surface crossovers 193 and 194 are imprinted on the embryonic paper web. In this manner, uncompressed zones of paper are defined by discontinuous picket-like lineaments wherein the fibers of the paper are alternately compacted and not compacted. The planchets 196 are provided in FIG. 8 to indicate the plan-view shape of the above described cavities.

Figure 11:
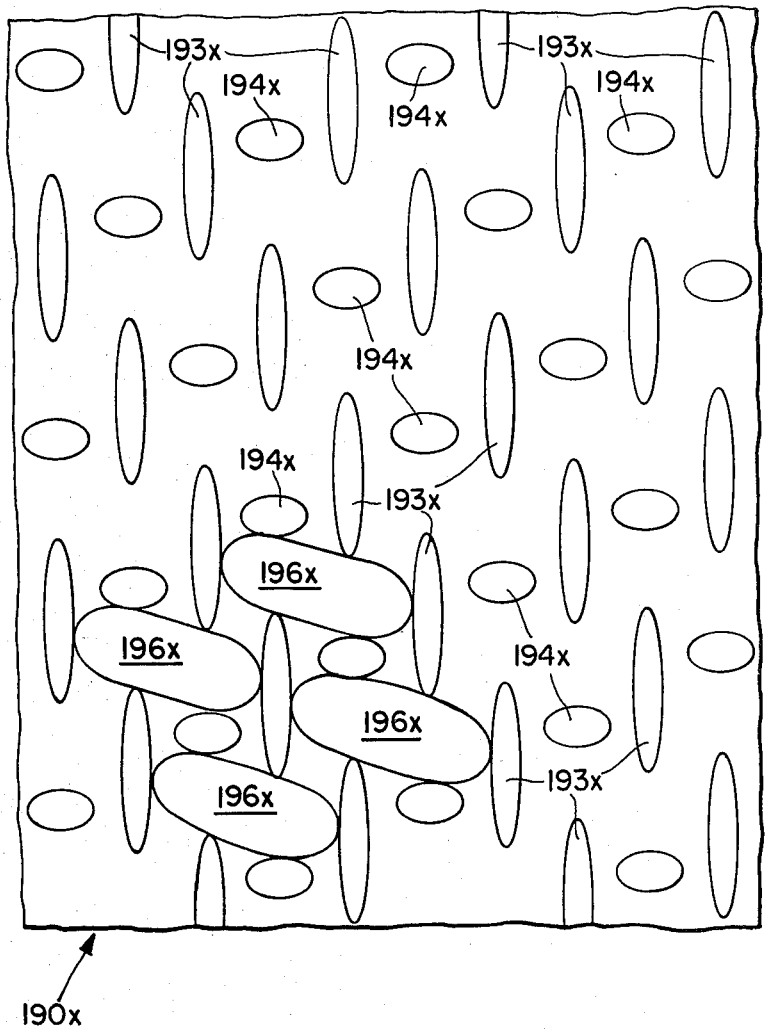
FIG. 11 is an enlarged scale, fragmentary view of a sheet of paper which has had printed on it the knuckle pattern of the imprinting fabric shown in FIG. 8.

FIG. 11 is a plan view of a fragmentary sheet of paper 190x which has had the pattern of flat-face crossovers 193 and 194 of fabric 190, FIG. 8, printed (not imprinted) thereon. The prints of crossovers 193 are designated 193x and the prints of crossovers 194 are designated 194x. Planchets 196x are indicated on FIG. 11 to illustrate the plan view shape of the zones of an embryonic paper web which would not be substantially compressed by imprinting it with fabric 190 prior to its final drying and creping. This view dramatically evidences the absence of impressions from sub-top-surface crossovers 195, FIGS. 8 and 10.

Figure 12:
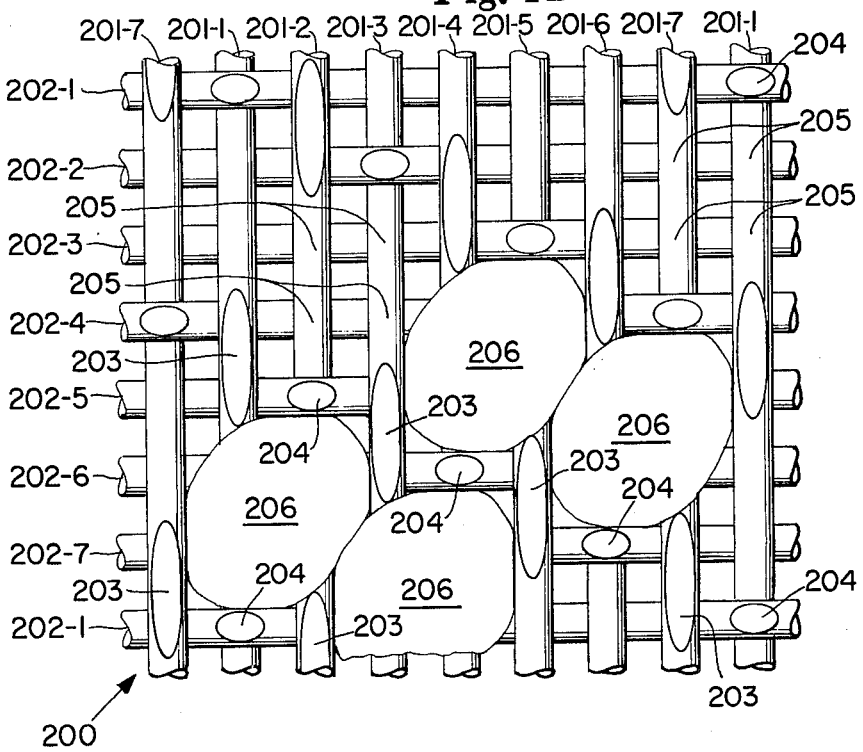
FIGS. 12 through 15 are enlarged scale, fragmentary views of 7-shed, 7-shed, 8-shed, and 9-shed satin weave imprinting fabrics, respectively, which are alternate embodiments of the present invention and which have all been woven using non-numerically-consecutive warp-pick-sequences.

FIG. 12 is a plan view of a fragmentary piece of an alternate embodiment imprinting fabric 200 which is a seven-shed satin weave which comprises warps 201-1 through 201-7 and shutes 202-1 through 202-7, and which fabric has been woven with a 1, 3, 5, 7, 2, 4, 6 warp-pick-sequence. The warps and shutes have coplanar flat-face top-surface-plane knuckles 203 and 204, respectively, and sub-top-surface knuckles 205. Planchets 206 are provided to indicate the cavities of the fabric 200 which would not substantially compress or compact the juxtaposed portions of a sheet of paper being imprinted with the knuckle pattern of fabric 200. Each cavity spans a sub-array of two-by-two sub-top-surface knuckles 205. However, whereas the coplanar knuckle pattern of fabric 190, FIG. 8, substantially completely perimetrically encloses discrete cavities indicated by planchets 196, the cavities of fabric 200 indicated by planchets 206, FIG. 12, are in diagonally abutting relation. Therefore, paper imprinted with fabric 200 will tend to have diagonally extending uncompressed ridges which are alternately spaced with diagonally extending lines of compression which are imprinted by alternately spaced coplanar knuckles 203 and 204. Alternatively, fabric 200 may be viewed as comprising diagonally extending troughs comprising diagonally abutting cavities in which troughs zones of paper being imprinted by fabric 200 will not be substantially compressed or compacted.

Figure 13:
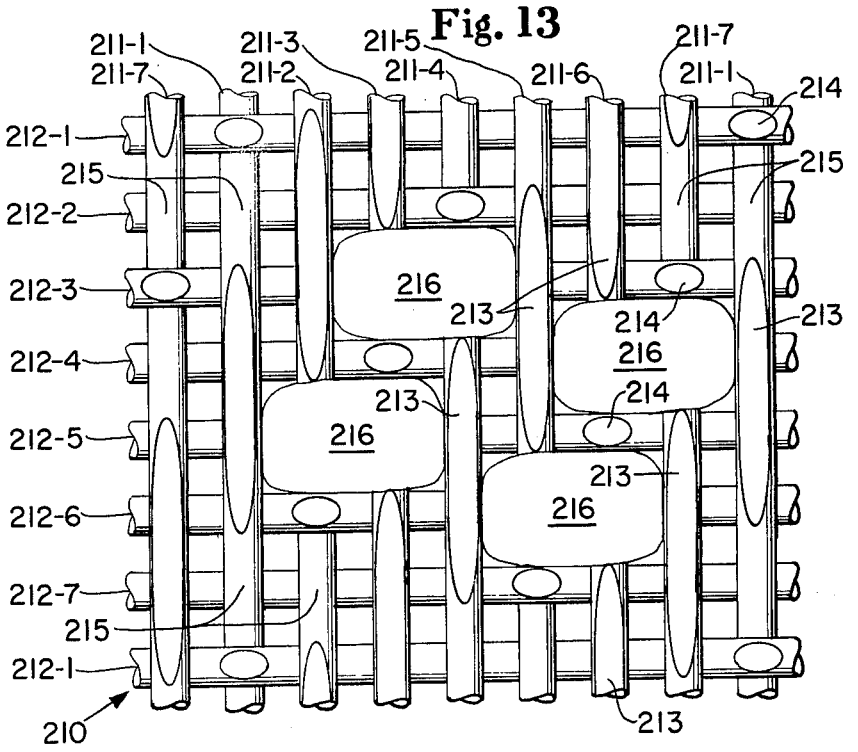

FIG. 13 is a plan view of a fragmentary piece of another alternate imprinting fabric 210 embodying the present invention. Fabric 210 is a seven-shed satin weave which comprises warps 211-1 through 211-7 and shutes 212-1 through 212-7, and which fabric has been woven with a 1, 4, 7, 3, 6, 2, 5 warp-pick-sequence. The warps and shutes have coplanar top-surface-plane knuckles 213 and 214, respectively, and sub-top-surface knuckles 215. Planchets 216 indicate wicker-basket-like cavities which each span a sub-array of two side-by-side sub-top-surface knuckles 215; the same spans as fabric 190, FIG. 8.

Figure 14:
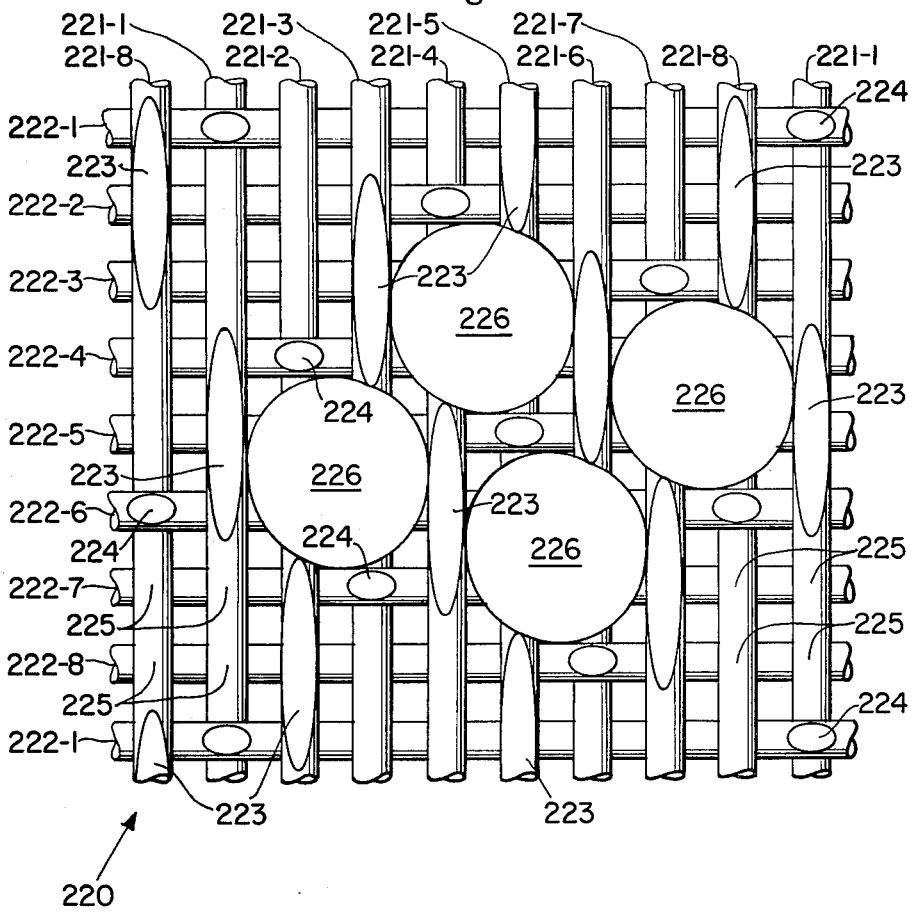

FIG. 14 is a plan view of a fragmentary piece of yet another alternate imprinting fabric 220 embodying the present invention. Fabric 220 is an eight-shed satin weave which comprises warps 221-1 through 221-8 and shutes 222-1 through 222-8, and which fabric has been woven with a 1, 4, 7, 2, 5, 8, 3, 6 warp-pick-sequence. The warps and shutes have top-surface-plane knuckles 223 and 224, respectively, and two-by-two sub-arrays of sub-top-surface knuckles 225. Planchets 226 indicate substantially isotropic wicker-basket-like cavities which are said to be isotropic because each spans equal number of warp and shute filaments; two each.

Figure 15:
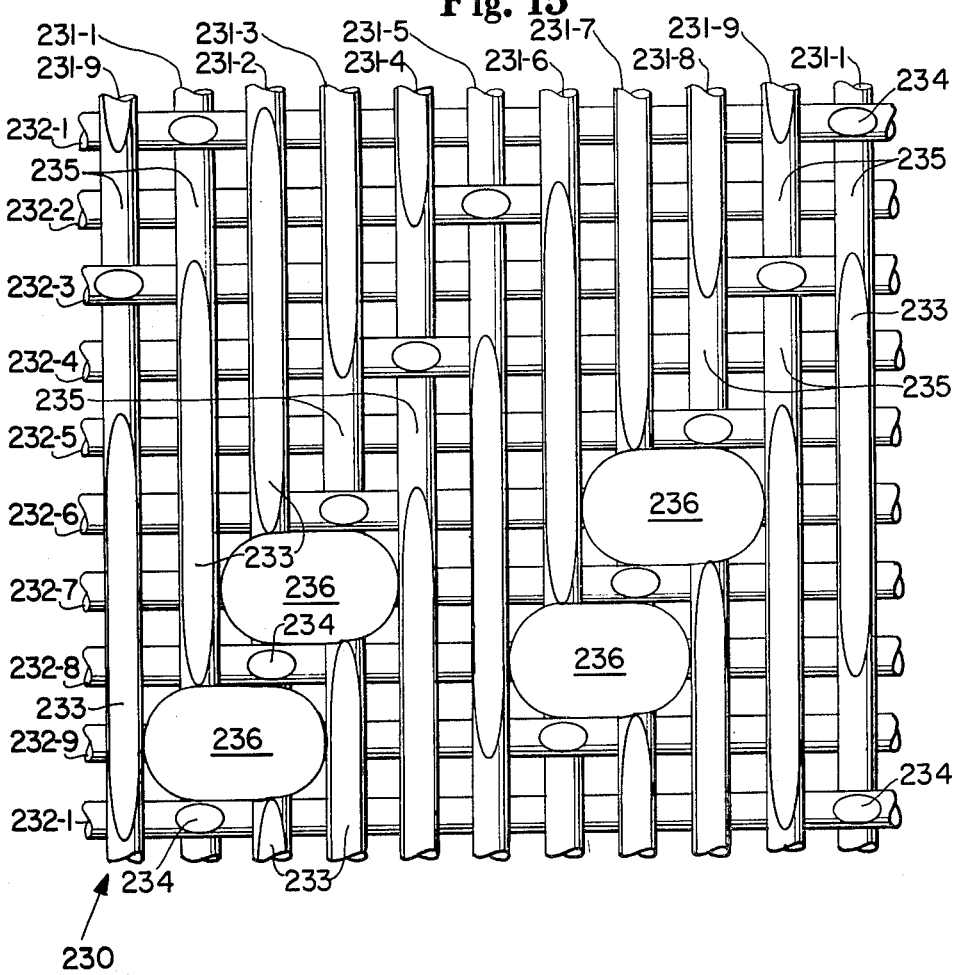

FIG. 15 is a plan view of a fragmentary piece of yet another alternate imprinting fabric 230 embodying the present invention. Fabric 230 is a nine-shed satin weave which comprises warps 231-1 through 231-9 and shutes 232-1 through 232-9, and which fabric has been woven with a 1, 5, 9, 4, 8, 3, 7, 2, 6 warp-pick-sequence. The warps and shutes have coplanar top-surface-plane knuckles 233 and 234, respectively, and two-by-two sub-arrays of sub-top-surface knuckles 235. Planchets 236 indicate wicker-basket-like cavities which each span two warp filaments and one shute filament; substantially the same size but not as closely spaced as the cavities indicated by planchets 156, 196, and 216 of fabrics 150, 190, and 210 shown in FIGS. 4, 8, and 13, respectively.

Additional alternate imprinting fabrics embodying the present invention could, of course, be provided by reversing the designations of warps and shutes in the alternate embodiments described hereinbefore, and/or by taking complimentary warp pick sequences as described hereinbefore: e.g., the compliment of warp pick sequence 1, 3, 5, 2, 4 is 1, 4, 2, 5, 3. These additional alternate embodiments are neither shown nor described because of the undue multiplicity and proloxity they would entail. Moreover, while all of the fabric embodiments shown and described have coplanar flat areas on both warp and shute crossovers, and each has been described in the imprinting fabric context, it is not intended to thereby limit the present invention to imprinting fabrics only or to fabrics having flat-faced crossovers. Furthermore, while only particular embodiments of the present invention have been illustrated and described, it would be obvious to those skilled in the art that various other changes and modifications can be made without departing from the spirit and scope of the invention. Therefore, it is intended to cover in the appended claims all such changes and modifications that are within the scope of this invention.

What is claimed is:

1. A loop of fabric for use on a papermaking machine, said fabric comprising a first set of filaments which filaments are disposed generally parallel with respect to each other and a second set of filaments which filaments are generally disposed in parallel relation to each other and which filaments are relatively steeply angularly disposed with respect to the filaments of said first set of filaments, said sets of filaments being interwoven and complementarily serpentinely configured to provide a predetermined first grouping of coplanar top-surface-plane crossovers of both said sets of filaments, and a predetermined second grouping of recessed sub-top-surface crossovers, said top-surface-plane crossovers being in spaced relation to define an array of wicker-basket-like cavities which cavities are disposed in a sufficiently staggered relation in both the machine direction and the cross machine direction to preclude adjacent said cavities being aligned in either the machine direction or the cross machine direction, each said cavity spanning at least one said sub-top-surface crossover and perimetrically enclosed by a picket-like-lineament comprising a plurality of said top-surface-plane crossovers.

2. The loop of fabric of claim 1 wherein said sets of filaments are disposed in orthogonal relation to each other, said filaments are thermoplastic monofilaments, and said serpentine configurations are heat set.

3. The loop of fabric of claim 2 wherein the upwardly facing surface of each said top-surface-plane crossover is substantially flat and all of the flat surfaces corporately define a plane denominated the top surface plane of said fabric.

4. The loop of fabric of claim 2 wherein the set of filaments which form the longest top-surface-plane crossovers of said fabric are aligned with the machine-direction of said papermachine.

5. The loop of fabric of claim 1, 2, 3, or 4 wherein said fabric is woven with a satin weave having a shed of at least five (5) and a non-numerically-consecutive warp-pick-sequence, said satin weave being characterized by all of the filaments of said first set crossing over one filament and under the number of filaments equal to one less than the shed count of said fabric, and by all of the filaments of said second set passing under one filament and over the number of filaments equal to one less than the shed count of said fabric.

6. The loop of fabric of claim 5 having a shed of five; each said cavity spans one generally cross-machine-direction extending filament and two generally machine-direction extending filaments; and said fabric has a mesh count of from about 10 by 10 to about 120 by 120 filaments per inch.

7. The loop of fabric of claim 6 wherein said fabric has a preferred mesh count of from about 18 by 16 to about 45 by 38 filaments per inch.

8. The loop of fabric of claim 5 wherein each said cavity spans a sub-array of at least two-by-two said sub-top-surface crossovers.

9. The loop of fabric of claim 8 wherein said fabric is a seven shed satin weave and wherein each filament of said first set of filaments alternately crosses over one and under six successive filaments of said second set and wherein a one-over crossover of each successive filament of said first set is offset two filaments of said second set from an adjacent one-over crossover of the preceding filament of said first set whereby each said cavity spans a sub-array of two-by-two said sub-top-surface crossovers.

10. The loop of fabric of claim 8 wherein said fabric is an eight shed satin weave wherein each filament of said first set of filaments alternately crosses over one and under seven successive filaments of said second set and wherein a one-over crossover of each successive filament of said first set is offset three filaments of said second set from an adjacent one-over crossover of the preceding filament of said first set whereby each said cavity spans a sub-array of two-by-two said sub-top-surface crossovers.

11. The loop of fabric of claim 1, 2, or 3 wherein each filament of each set of filaments comprises a plurality of top-surface-plane crossovers which span subsets of at least two side-by-side filaments of the other set of filaments, and wherein a said top-surface-plane crossover of each filament of each adjacent pair of parallel filaments is in offset relation to the other by the number of filaments spanned by each said crossover.

12. The loop of fabric of claim 11 wherein all of the top-surface-plane crossovers of each filament of both said sets of filaments span equal numbers of orthogonally disposed side-by-side filaments and wherein said sub-top-surface crossovers are so disposed that said cavities are substantially isotropic.

13. The loop of fabric of claim 12 wherein said fabric is a five shed weave wherein each filament of said first set of filaments alternately crosses over two and under three side-by-side filaments of said second set of filaments and each said cavity spans on said sub-top-surface crossover.

14. The loop of fabric of claim 12 wherein said fabric is a ten shed weave wherein each filament of said first set of filaments alternately crosses over three and under seven side-by-side filaments of said second set of filaments and wherein each said cavity spans a sub-array of two-by-two said sub-top-surface crossovers.

15. The loop of fabric of claim 12 wherein said fabric is a seventeen shed weave wherein each filament of said first set of filaments alternately crosses over four and under thirteen filaments of said second set of filaments and wherein each said cavity spans a sub-array of three-by-three said sub-top-surface crossovers.

16. The loop of fabric of claim 11 wherein said fabric is a seven shed weave wherein each filament of said first set of filaments alternately crosses over three and under four side-by-side filaments of said second set of filaments and each said cavity spans a sub-set of two adjacent said sub-top-surface crossovers.

17. The loop of fabric of claim 16 wherein said first set of filaments extend in the machine-direction of said papermaking machine.

* * * * *